US009541849B2

(12) United States Patent
Shimizu et al.

(10) Patent No.: US 9,541,849 B2
(45) Date of Patent: Jan. 10, 2017

(54) POSITIVELY CHARGEABLE SINGLE-LAYER ELECTROPHOTOGRAPHIC PHOTOSENSITIVE MEMBER AND IMAGE FORMING APPARATUS

(71) Applicant: KYOCERA DOCUMENT SOLUTIONS INC., Osaka (JP)

(72) Inventors: Tomofumi Shimizu, Osaka (JP); Hiroki Tsurumi, Osaka (JP); Yohei Yamamoto, Osaka (JP); Eiichi Miyamoto, Osaka (JP)

(73) Assignee: KYOCERA Document Solutions Inc., Osaka (JP)

( * ) Notice: Subject to any disclaimer, the term of this patent is extended or adjusted under 35 U.S.C. 154(b) by 0 days.

(21) Appl. No.: 14/191,120

(22) Filed: Feb. 26, 2014

(65) Prior Publication Data

US 2014/0242507 A1 Aug. 28, 2014

(30) Foreign Application Priority Data

Feb. 27, 2013 (JP) ..... 2013-038025

(51) Int. Cl.
*G03G 5/06* (2006.01)

(52) U.S. Cl.
CPC ..... *G03G 5/0609* (2013.01); *G03G 5/0614* (2013.01); *G03G 5/0616* (2013.01); *G03G 5/0618* (2013.01); *G03G 5/0651* (2013.01); *G03G 5/0672* (2013.01)

(58) Field of Classification Search
CPC ... G03G 5/0609; G03G 5/0616; G03G 5/0618
USPC ..... 430/58.25, 70, 72, 83, 56
See application file for complete search history.

(56) References Cited

U.S. PATENT DOCUMENTS

| | | | | |
|---|---|---|---|---|
| 5,328,789 | A * | 7/1994 | Nakamori et al. | 430/58.25 |
| 5,430,526 | A * | 7/1995 | Ohkubo et al. | 399/159 |
| 8,980,507 | B2 * | 3/2015 | Shimizu | G03G 5/0609 430/56 |
| 2004/0058257 | A1 * | 3/2004 | Azuma et al. | 430/56 |
| 2008/0305418 | A1 * | 12/2008 | Hamasaki | G03G 5/0564 430/78 |

FOREIGN PATENT DOCUMENTS

| | | | |
|---|---|---|---|
| JP | H09-281728 | A | 10/1997 |
| JP | H11-311872 | A | 11/1999 |
| JP | 2001-242656 | A | 9/2001 |
| JP | 2002-244319 | A | 8/2002 |
| JP | 2003-005396 | A | 1/2003 |
| JP | 2005-208618 | A | 8/2005 |
| JP | 2006-010824 | A | 1/2006 |
| JP | 2007-322468 | A | 12/2007 |
| JP | 2008-164960 | A | 7/2008 |
| JP | 2012-208231 | A | 10/2012 |

OTHER PUBLICATIONS

Diamond, A.S., ed., Handbook of Imaging Materials, Marcel Dekker, Inc., NY (1991), pp. 395-396.*

(Continued)

*Primary Examiner* — Janis L Dote

(74) *Attorney, Agent, or Firm* — Studebaker & Brackett PC

(57) ABSTRACT

A positively chargeable single-layer electrophotographic photosensitive member includes a single-layer photosensitive layer. The single-layer photosensitive layer contains a charge generating material, a hole transport material, an electron transport material, and a binder resin. The electron transport material contains two or more compounds selected from the group consisting of compounds represented by the chemical formulas (1) to (4) below.

(1)

(2)

(3)

(4)

7 Claims, 2 Drawing Sheets

(56) References Cited

OTHER PUBLICATIONS

ESPACENET European Patent Office machine-assisted English-language translation of JP 11-311872 (A) (pub. Nov. 1999).*
Brother Laser Prnter Service Manual Model: HL-1240/1250 (pub. Aug. 1999), pp. ii-vi, 3-17 through 3-24.*
An Office Action; "Notice of Reasons for Rejection," issued by the Japanese Patent Office on Jun. 2, 2015, which corresponds to Japanese Patent Application No. 2013-038025 and is related to U.S. Appl. No. 14/191,120.
An Office Action; "Notice of Reasons for Rejection," issued by the Japanese Patent Office on Dec. 15, 2015, which corresponds to Japanese Patent Application No. 2013-038025 and is related to U.S. Appl. No. 14/191,120.

* cited by examiner

POSITIVELY CHARGEABLE SINGLE-LAYER ELECTROPHOTOGRAPHIC PHOTOSENSITIVE MEMBER AND IMAGE FORMING APPARATUS

INCORPORATION BY REFERENCE

The present application claims priority under 35 U.S.C. §119 to Japanese Patent Application No. 2013-038025, filed Feb. 27, 2013. The contents of this application are incorporated herein by reference in their entirety.

BACKGROUND

The present disclosure relates to positively chargeable single-layer electrophotographic photosensitive members each including a photosensitive layer that contains a hole transport material and two or more electron transport materials selected from a group consisting of compounds each having a particular chemical structure. The present disclosure also relates to image forming apparatuses that includes such a positively chargeable single-layer electrophotographic photosensitive member as an image bearing member.

An electrophotographic image forming apparatus includes an electrophotographic photosensitive member. Examples of an electrophotographic photosensitive member include inorganic photosensitive members and organic photosensitive members. An inorganic photosensitive member includes a photosensitive layer made from an inorganic material, such as selenium or amorphous silicon. An organic photosensitive member includes a photosensitive layer mainly made from organic materials, such as a binder resin, a charge generating material, and a charge transport material. Of these electrophotographic photosensitive members, organic photosensitive members are widely used for the following reason. That is, organic photosensitive members can be produced more easily than inorganic photosensitive members, and materials for the photosensitive layer can be selected from a wide variety of materials. Organic photosensitive members thus provide high design flexibility.

Examples of such organic photosensitive members include single-layer organic photosensitive members and multi-layer organic photosensitive members. A single-layer organic photosensitive member includes a photosensitive layer containing both a charge generating material and a charge transport material within the layer. A multi-layer organic photosensitive member includes a photosensitive layer that is a stack of a charge generating layer containing a charge generating material and a charge transport layer containing a charge transport material. As compared with multi-layer organic photosensitive members, single-layer organic photosensitive members are known to be simple in configuration, easy to be manufactured, and capable of reducing occurrence of film defects.

With the use of such an electrophotographic photosensitive member, an image forming process including the following steps (1) through (5) is performed.

(1) charging a surface of the electrophotographic photosensitive member;

(2) exposing the charged surface of the electrophotographic photosensitive member to light to form an electrostatic latent image;

(3) developing the electrostatic latent image with toner in the presence of a developing bias voltage applied;

(4) transferring the thus formed toner image to a transfer target by reversal development; and (5) heating to fix the toner image transferred to the transfer target.

The electrophotographic photosensitive member is rotated for use during such an image forming process. Therefore, a phenomenon occurs that the potential (light potential) of a portion which has been exposed during image formation remains, and therefore, even after the charging step in the next turn of the photosensitive member, a desired charge potential (dark potential) cannot be obtained at the portion which has been exposed in the previous turn. This phenomenon is called "transfer memory." Portions with and without transfer memory have different image densities, and therefore, it is difficult to obtain a satisfactory image.

Furthermore, single-layer electrophotographic photosensitive members may be of a positively chargeable type and a negatively chargeable type. The techniques employed for charging the electrophotographic photosensitive member include contact charging and non-contact charging. The use of a positively chargeable single-layer electrophotographic photosensitive member is preferable, and the combined use of a positively chargeable single-layer electrophotographic photosensitive member with a contact-type charger is more preferable for the following reason. That is, the surface of an electrophotographic photosensitive member can be charged substantially without generating oxidizing gas such as ozone, which adversely affects the life of the electrophotographic photosensitive member or the office environment. However, the combined use of a positively chargeable single-layer electrophotographic photosensitive member with a contact-type charger presents a problem of being particularly prone to transfer memory.

In view of the above circumstances, demand exists for positively chargeable single-layer electrophotographic photosensitive members capable of reducing occurrence of transfer memory during image formation. The use of a charge transport material having an excellent charge transport function is effective to reduce occurrence of transfer memory. Examples of a charge transport material having an excellent charge transport function include a compound usable as a charge transport material and represented by the following chemical formula:

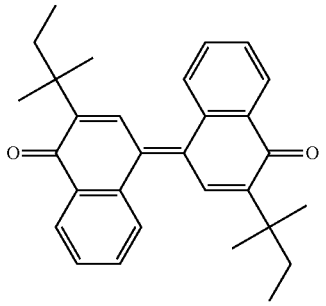

SUMMARY

The present disclosure provides the following.

A first aspect of the present disclosure relates to a positively chargeable single-layer electrophotographic photosensitive member.

The positively chargeable single-layer electrophotographic photosensitive member includes a single-layer photosensitive layer. The single-layer photosensitive layer at least contains a charge generating material, a hole transport material, an electron transport material, and a binder resin, The electron transport material contains two or more compounds selected from the group consisting of compounds represented by the chemical formulas (1) to (4) shown below:

(1)

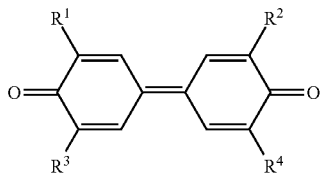

(2)

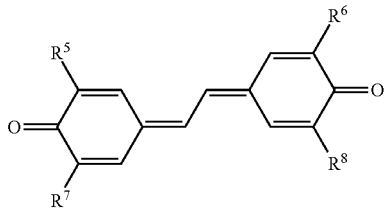

(3)

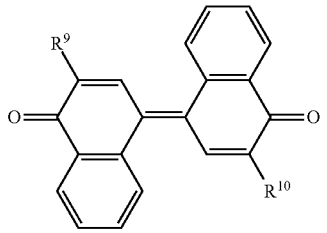

(4)

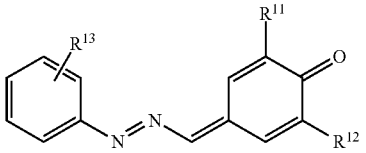

In the chemical formulas (1) to (4), $R^1$ to $R^{12}$ each independently represent one selected from the group consisting of a hydrogen atom, an optionally substituted alkyl group, an optionally substituted alkenyl group, an optionally substituted alkoxy group, an optionally substituted aralkyl group, an optionally substituted aromatic hydrocarbon group, and an optionally substituted heterocyclic group, and $R^{13}$ represents one selected from the group consisting of a halogen atom, a hydrogen atom, an optionally substituted alkyl group, an optionally substituted alkenyl group, an optionally substituted alkoxy group, an optionally substituted aralkyl group, an optionally substituted aromatic hydrocarbon group, and an optionally substituted heterocyclic group.

A second aspect of the present disclosure relates to an image forming apparatus.

The image forming apparatus includes:

an image bearing member;

a charger configured to charge a surface of the image bearing member;

an exposure section configured to expose the charged surface of the image bearing member to light to form an electrostatic latent image on the surface of the image bearing member;

a developing section configured to develop the electrostatic latent image into a toner image; and a transfer section configured to transfer the toner image from the image bearing member to a transfer target. The image bearing member is a positively chargeable single-layer electrophotographic photosensitive member according to the first aspect.

DETAILED DESCRIPTION

The following describes embodiments of the present disclosure in detail. The present disclosure is in no way limited to the specific embodiments below, and various modifications may be made to practice the present disclosure within the scope of the aim of the present disclosure. Note that some overlapping explanations may be appropriately omitted, but such omission is not intended to limit the gist of the disclosure.

[First Embodiment]

A first embodiment is directed to a positively chargeable single-layer electrophotographic photosensitive member (hereinafter, may be referred to also as a single-layer photosensitive member or as a photosensitive member). The positively chargeable single-layer electrophotographic photosensitive member includes a photosensitive layer of a single-layer configuration (hereinafter, the photosensitive layer may be referred to also as a single-layer photosensitive layer or a photosensitive layer) that at least contains a charge generating material, a hole transport material, an electron transport material, and a binder resin. The electron transport material contains two or more compounds selected from the group consisting of compounds represented by the chemical formulas (1) to (4) shown above.

Figure 1A:
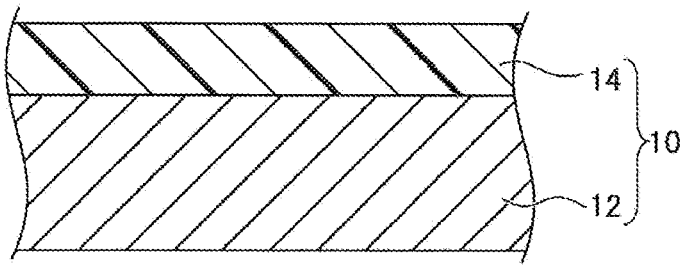
FIGS. 1A, 1B, and 1C are views each showing a configuration of a positively chargeable single-layer electrophotographic photosensitive member.
Figure 1B:
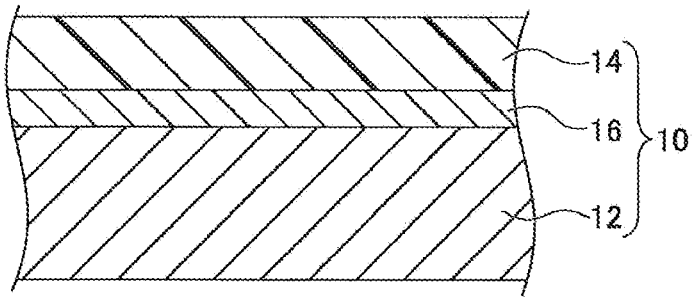
Figure 1C:
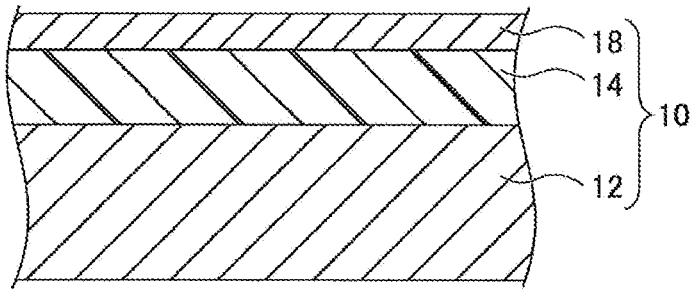

FIGS. 1A, 1B, and 1C are views each showing an example of the configuration of the positively chargeable single-layer electrophotographic photosensitive member 10. The positively chargeable single-layer electrophotographic photosensitive member 10 includes a conductive substrate 12 and a single-layer photosensitive layer 14. The single-layer photosensitive layer 14 is formed over the conductive substrate 12 and contains a charge generating material, a hole transport material, an electron transport material, and a binder resin. In particular, for example, FIG. 1A shows one configuration of the positively chargeable single-layer electrophotographic photosensitive member 10. As in this configuration, the positively chargeable single-layer electrophotographic photosensitive member 10 may include the photosensitive layer 14 directly on the conductive substrate 12. FIG. 1B shows another configuration of the positively chargeable single-layer electrophotographic photosensitive member 10. In this configuration, the positively chargeable single-layer electrophotographic photosensitive member 10 may include an intermediate layer 16 between the conductive substrate 12 and the photosensitive layer 14. FIG. 1C shows a yet another configuration of the positively chargeable single-layer electrophotographic photosensitive member 10. As in the positively chargeable single-layer electrophotographic photosensitive member 10 shown in FIG. 1A or 1B, the photosensitive layer 14 may be the outermost layer to be exposed to the outside. Alternatively, as shown in FIG. 1C, the positively chargeable single-layer electrophotographic photosensitive member 10 may include a protective layer 18 on the photosensitive layer 14.

The following describes the conductive substrate 12 and the photosensitive layer 14 in order.

[Conductive Substrate]

The conductive substrate 12 is not particularly limited as long as it is usable as the conductive substrate of the positively chargeable single-layer electrophotographic photosensitive member 10. Specific examples include, among others, a conductive substrate at least a surface portion of which is made of a conductive material. In particular, the conductive substrate 12 may be made from a conductive material. Alternatively, the conductive substrate 12 may be made from a plastic material or the like having a surface coated with a conductive material. Examples of conductive materials include aluminum, iron, copper, tin, platinum, silver, vanadium, molybdenum, chromium, cadmium, titanium, nickel, palladium, indium, stainless steel, and brass. It is applicable to use a single conductive material as the conductive material. Alternatively, two or more conductive materials may be combined and used as an alloy, for example. From the standpoint of the material properties of the conductive substrate, aluminum or aluminum alloy is preferable among the materials mentioned above.

The shape of the conductive substrate 12 can be appropriately selected depending on the configuration of the image forming apparatus used. The conductive substrate 12 that can be suitably used may have the shape of a sheet, drum, or the like, for example. In addition, the thickness of the conductive substrate 12 can be appropriately selected depending on the above-described shape of the substrate.

[Photosensitive Layer]

The photosensitive layer 14 at least contains a charge generating material, a hole transport material, an electron transport material, and a binder resin. The electron transport material in the photosensitive layer 14 contains two or more compounds selected from the group consisting of compounds represented by the chemical formulas (1) to (4) below:

(1)

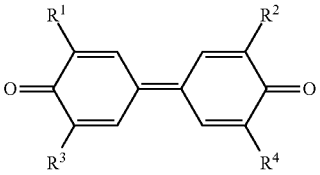

(2)

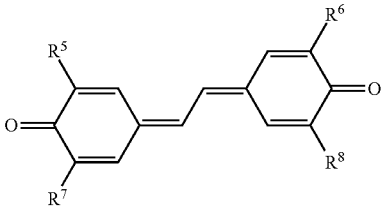

(3)

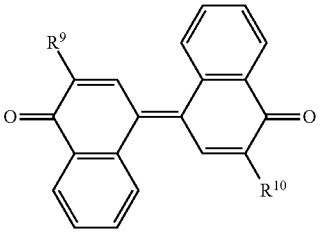

-continued (4)

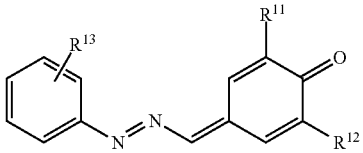

In the chemical formulas (1) to (4), $R^1$ to $R^{12}$ each independently represent one selected from the group consisting of a hydrogen atom, an optionally substituted alkyl group, an optionally substituted alkenyl group, an optionally substituted alkoxy group, an optionally substituted aralkyl group, an optionally substituted aromatic hydrocarbon group, and an optionally substituted heterocyclic group, and $R^{13}$ represents one selected from the group consisting of a halogen atom, a hydrogen atom, an optionally substituted alkyl group, an optionally substituted alkenyl group, an optionally substituted alkoxy group, an optionally substituted aralkyl group, an optionally substituted aromatic hydrocarbon group, and an optionally substituted heterocyclic group.

The presence of the two or more compounds selected from the group consisting of compounds represented by the chemical formulas (1) to (4) in the photosensitive layer 14 of the positively chargeable single-layer electrophotographic photosensitive member 10 serves to reduce occurrence of transfer memory in the transferring step of the image forming process. The following describes transfer memory occurring during the image forming process.

The image forming process employing an electrophotographic technique typically includes a charging step, an exposing step, a developing step, a transferring step, and a static elimination step, for example. In the charging step, an image bearing surface, which is a surface of the positively chargeable single-layer electrophotographic photosensitive member 10, is uniformly charged to a predetermined potential to build up positive charges. Next, in the exposing step, the surface of the positively chargeable single-layer electrophotographic photosensitive member 10 charged to the predetermined potential is exposed to light, so that an electrostatic latent image is formed thereon.

Subsequently, in the developing step, toner is supplied to the exposed regions to form a toner image to visualize the electrostatic latent image. In the transferring step, the toner image formed on the surface of the positively chargeable single-layer electrophotographic photosensitive member 10 is transferred to an intermediate transfer member. Here, in the step of transferring the toner image to the intermediate transfer member, a bias having a negative polarity, which is reverse to the polarity of the charges on the positively chargeable single-layer electrophotographic photosensitive member 10, is applied to the intermediate transfer member.

At the time the bias having a negative polarity is applied to the intermediate transfer member, the toner image is present on the surface of the exposed regions. Therefore, even if the bias having a negative polarity is applied, the charging polarity of the exposed regions remains the same (remains positive). However, the unexposed regions are without toner forming the toner image on their surface. Therefore, the application of the bias having a negative polarity produces charges of the reversed polarity to the charging polarity (negative polarity). As a result, the exposed and unexposed regions of the positively chargeable single-layer electrophotographic photosensitive member 10 have potentials of different polarities. This potential difference between the exposed and unexposed regions is a cause of transfer memory during the subsequent image formation.

Therefore, the photosensitive layer 14 according to the present disclosure contains an electron transport material containing two or more compounds selected from the group consisting of compounds represented by the chemical formulas (1) to (4). This eliminates the cause of the transfer memory, i.e., the negative charges on the unexposed regions, and thus reduces occurrence of transfer memory in the transferring step.

The following describes the charge generating material, the hole transport material, the electron transport material, the binder resin, and one or more additives, all of which are the components of the photosensitive layer 14, and also describes a method for manufacturing the positively chargeable single-layer electrophotographic photosensitive member 10.

(Charge Generating Material)

Specific examples of the charge generating material include X-form metal-free phthalocyanine (x-$H_2$Pc) represented by the chemical formula (I) below, α- or Y-form titanyl phthalocyanine (Y—TiOPc) represented by the chemical formula (II) below, perylene pigments, bis-azo pigments, dithioketopyrrolopyrrole pigments, metal-free naphthalocyanine pigments, metal naphthalocyanine pigments, squaraine pigments, tris-azo pigments, indigo pigments, azulenium pigments, cyanine pigments, powders of inorganic photoconductive materials (for example, selenium, selenium-tellurium, selenium-arsenic, cadmium sulfide, and amorphous silicon), pyrylium salts, anthanthrone based pigments, triphenylmethane based pigments, threne based pigments, toluidine based pigments, pyrazoline based pigments, and quinacridone based pigments. Of these charge generating materials mentioned above, X-form metal-free phthalocyanine or α- or Y-form titanyl phthalocyanine is preferable.

(I)

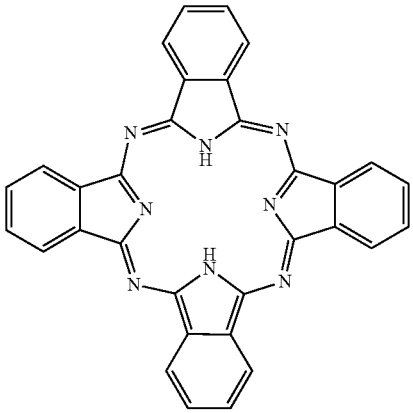

-continued (II)

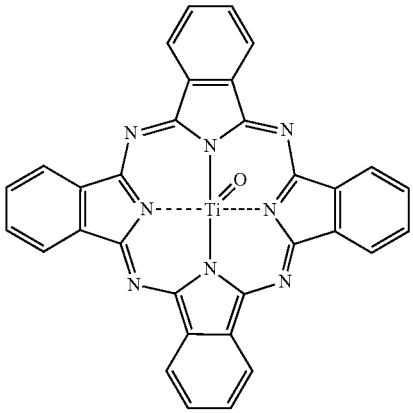

To improve the sensitivity, it is preferable to use, as the charge generating material, titanyl phthalocyanine as described below.

Titanyl phthalocyanine satisfying both: (A) in CuKα characteristic X-ray diffraction spectrum, a main peak appears at a Bragg angle of 2θ±0.2°=27.2°; and (B) in differential scanning calorimetry, a single peak appears within a range of 50° C. to 270° C. except for the peak caused by vaporization of absorbed water.

Titanyl phthalocyanine satisfying both: the characteristic (A) descried above; and (C) in differential scanning calorimetry, no peak appears within a range of 50° C. to 400° C. except for the peak caused by vaporization of absorbed water.

Titanyl phthalocyanine satisfying both: the characteristic (A) descried above; and (D) in differential scanning calorimetry, no peak appears within a range of 50° C. to 270° C. except for the peak caused by vaporization of absorbed water and a single peak appears within a range of 270° C. to 400° C.

A charge generating material having an absorption wavelength within a desired range may be used alone, or two or more such charge generating materials may be used in combination. Further, among these charge generating materials mentioned above, the use of the positively chargeable single-layer photosensitive member 10 having sensitivity in a wavelength range of 700 nm or longer is preferable especially for image forming apparatuses employing a digital optical system (for example, laser beam printers or fax machines including a semiconductor laser as the light source). As the charge generating material, a phthalocyanine based pigment (for example, metal-free phthalocyanine or titanyl phthalocyanine) is suitably used. The crystal form of the phthalocyanine based pigment is not particularly limited, and various crystal forms are applicable. For image forming apparatuses employing an analog optical system (for example, an electrostatic process copier including a white light source, such as a halogen lamp), the positively chargeable single-layer photosensitive member 10 having sensitivity in a visible range is preferred. Therefore, a perylene pigment or a bis-azo pigment is preferable for the electrophotographic photosensitive member of such an image forming apparatus.

(Hole Transport Material)

Specific examples of the hole transport material include benzidine derivatives, oxadiazole based compounds (for example, 2,5-di(4-methylaminophenyl)-1,3,4-oxadiazole), styryl based compounds (for example, 9-(4-diethylaminostyryl)anthracene), carbazole based compounds (for example, polyvinyl carbazole), organic polysilane compounds, pyrazoline based compounds (for example, 1-phenyl-3-(p-dimethylaminophenyl)pyrazoline), nitrogen containing cyclic compounds (for example, hydrazone based compounds, triphenylamine based compounds, indole based compounds, oxazole based compounds, isoxazole based compounds, thiazole based compounds, and triazole based compounds), and condensed polycyclic compounds. Among these hole transport materials, a triphenylamine based compound having one or multiple triphenylamine backbone in one molecule is more preferable. These hole transport materials may be used alone, or two or more of the hole transport materials may be used in combination.

(Electron Transport Material)

The electron transport material contains two or more compounds selected from the group consisting of compounds represented by the chemical formulas (1) to (4) below.

(1)

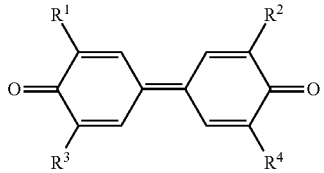

(2)

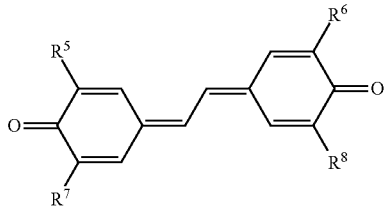

(3)

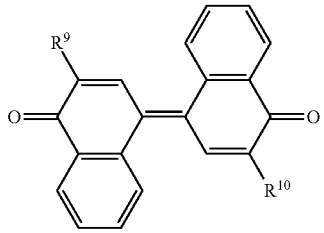

(4)

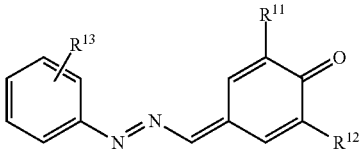

In the chemical formulas (1) to (4), $R^1$ to $R^{12}$ each independently represent one selected from the group consisting of a hydrogen atom, an optionally substituted alkyl group, an optionally substituted alkenyl group, an optionally substituted alkoxy group, an optionally substituted aralkyl group, an optionally substituted aromatic hydrocarbon group, and an optionally substituted heterocyclic group, and $R^{13}$ represents one selected from the group consisting of a halogen atom, a hydrogen atom, an optionally substituted alkyl group, an optionally substituted alkenyl group, an optionally substituted alkoxy group, an optionally substituted aralkyl group, an optionally substituted aromatic hydrocarbon group, and an optionally substituted heterocyclic group.

When any of $R^1$ to $R^{12}$ represents an optionally substituted alkyl group, the number of carbon atoms in the alkyl group is not particularly limited within a range not to impair the object of the present disclosure. Typically, the number of carbon atoms in the alkyl group is preferably from 1 to 10, and more preferably from 1 to 6, and particularly preferably from 1 to 4. The structure of the alkyl group may be straight chain, branched chain or cyclic, or any combination thereof. Examples of a substituent which may be present in the alkyl group include a halogen atom, a hydroxy group, an alkoxy group having 1 to 4 carbon atoms, and a cyano group. The number of substituents that may be present in the alkyl group is not particularly limited within a range not to impair the object of the present disclosure. Typically, a preferable number of substituents that may be present in the alkyl group is 3 or less.

Specific examples of the optionally substituted alkyl group include methyl group, ethyl group, n-propyl group, isopropyl group, cyclopropyl group, n-butyl group, isobutyl group, sec-butyl group, tert-butyl group, cyclobutyl group, n-pentyl group, cyclopentyl group, n-hexyl group, cyclohexyl group, n-heptyl group, n-octyl group, n-nonyl group, n-decyl group, chloromethyl group, dichloromethyl group, trichloromethyl group, cyanomethyl group, hydroxymethyl group, and hydroxyethyl group. Among these alkyl groups, methyl group, ethyl group, n-propyl group, isopropyl group, n-butyl group, isobutyl group, sec-butyl group, tert-butyl group, and tert-pentyl group are preferable.

When any of $R^1$ to $R^{12}$ represents an optionally substituted alkenyl group, the number of carbon atoms in the alkenyl group is not particularly limited within a range not to impair the object of the present disclosure. Typically, the number of carbon atoms in the alkenyl group is preferably from 2 to 10, and more preferably from 2 to 6, and particularly preferably from 2 to 4. The structure of the alkenyl group may be straight chain, branched chain or cyclic, or any combination thereof. Examples of a substituent which may be present in the alkenyl group include a halogen atom, a hydroxy group, an alkoxy group having 1 to 4 carbon atoms, and a cyano group. The number of substituents that may be present in the alkenyl group is not particularly limited within a range not to impair the object of the present disclosure. Typically, a preferable number of substituents that may be present in the alkenyl group is 3 or less.

Specific examples of the optionally substituted alkenyl group include vinyl group, 1-propenyl group, 2-propenyl group (allyl group), 1-butenyl group, 2-butenyl group, 3-butenyl group, 2-cyanovinyl group, 2-chlorovinyl group, and 3-chloroallyl group. Among these alkenyl groups, a vinyl group and 2-propenyl group (allyl group) are preferable.

When any of $R^1$ to $R^{12}$ represents an optionally substituted alkoxy group, the number of carbon atoms in the alkoxy group is not particularly limited within a range not to impair the object of the present disclosure. Preferably, the number of carbon atoms in the alkoxy group is typically from 1 to 10, and more preferably from 1 to 6, and particularly preferably from 1 to 4. The structure of the alkoxy group may be straight chain, branched chain or cyclic, or any combination thereof. Examples of a substituent which may be present in the alkoxy group include a halogen atom, a hydroxy group, an alkoxy group having 1 to 4 carbon atoms, and a cyano group. The number of substituents that may be present in the alkoxy group is not particularly limited within a range not to impair the object of the present disclosure. Typically, a preferable number of substituents that may be present in the alkyl group is 3 or less.

Specific examples of the optionally substituted alkoxy group include methoxy group, ethoxy group, n-propyloxy group, cyclopropyloxy group, isopropyloxy group, n-butyloxy group, isobutyloxy group, sec-butyloxy group, tert-butyloxy group, cyclobutyloxy group, n-pentyloxy group, cyclopentyloxy group, n-hexyloxy group, cyclohexyloxy group, n-heptyloxy group, n-octyloxy group, n-nonyloxy group, n-decyloxy group, chloromethyloxy group, dichloromethyloxy group, trichloromethyloxy group, cyanomethyloxy group, hydroxymethyloxy group, and hydroxyethyloxy group. Preferable among these alkoxy groups are methoxy group, ethoxy group, n-propyloxy group, isopropyloxy group, n-butyloxy group, isobutyloxy group, sec-butyloxy group, and tert-butyloxy group. More preferable are methoxy group and ethoxy group. Particularly preferable is methoxy group.

When any of $R^1$ to $R^{12}$ represents an optionally substituted aralkyl group, the number of carbon atoms in the aralkyl group is not particularly limited within a range not to impair the object of the present disclosure. Typically, the number of carbon atoms in an aralkyl group is preferably from 1 to 15, and more preferably from 1 to 13, and particularly preferably from 1 to 12. Examples of a substituent that may be present in the aralkyl group include a halogen atom, a hydroxy group, an alkyl group having from 1 to 4 carbon atoms, an alkoxy group having from 1 to 4 carbon atoms, a nitro group, a cyano group, an aliphatic acyl group having from 2 to 4 carbon atoms, a benzoyl group, a phenoxy group, an alkoxycarbonyl group containing an alkoxy group having from 1 to 4 carbon atoms, and a phenoxycarbonyl group. The number of substituents that may be present in the aralkyl group is not particularly limited within a range not to impair the object of the present disclosure. Typically, the number of substituents that may be present in the aralkyl group is preferably 5 or less, and more preferably 3 or less.

Specific examples of the optionally substituted aralkyl group include benzil group, 2-methylbenzil group, 3-methylbenzil group, 4-methylbenzil group, 2-chlorobenzil group, 3-chlorobenzil group, 4-chlorobenzil group, phenethyl group, α-naphthylmethyl group, β-naphthylmethyl group, α-naphthylethyl group, and β-naphthylethyl group. Preferable among these aralkyl groups are benzil group, phenethyl group, α-naphthylmethyl group, and β-naphthylmethyl group. More preferable are benzyl group and phenethyl group.

When any of $R^1$ to $R^{12}$ represents an optionally substituted aromatic hydrocarbon group, the optionally substituted aromatic hydrocarbon group is not particularly limited within a range not to impair the object of the present disclosure. Typically, the aromatic hydrocarbon group may preferably be a phenyl group or a group formed by two or three benzene rings fused by condensation or linked together by a single bond/single bonds. The number of benzene rings in the aromatic hydrocarbon group is preferably from 1 to 3, and more preferably 1 or 2. Examples of a substituent that may be present in the aromatic hydrocarbon group include halogen atom, hydroxy group, alkyl group having from 1 to 4 carbon atoms, alkoxy group having from 1 to 4 carbon atoms, nitro group, cyano group, aliphatic acyl group having from 2 to 4 carbon atoms, benzoyl group, phenoxy group, alkoxycarbonyl group containing alkoxy group having from 1 to 4 carbon atoms, and phenoxycarbonyl group.

Specific examples of the optionally substituted aromatic hydrocarbon group include phenyl group, o-tolyl group, m-tolyl group, p-tolyl group, o-chlorophenyl group, m-chlorophenyl group, p-chlorophenyl group, o-nitrophenyl group, m-nitrophenyl group, p-nitrophenyl group, α-naphthyl group, β-naphthyl group, biphenylyl group, anthry group, and phenanthryl group. Preferable among these aromatic hydrocarbon groups are phenyl group, p-nitrophenyl group, α-naphthyl group, and β-naphthyl group. More preferable are phenyl group and p-nitrophenyl group.

When any of $R^1$ to $R^{12}$ represents an optionally substituted heterocyclic group, the optionally substituted heterocyclic group is not particularly limited within a range not to impair the object of the present disclosure. Typically, the heterocyclic group is a five- or six-membered monocyclic ring which contains at least one hetero atom selected from the group consisting of a nitrogen atom, a sulfur atom, and an oxygen atom, a heterocyclic group in which such monocyclic rings are fused together, or a heterocyclic group in which such a monocyclic ring is fused with a five- or six-membered hydrocarbon ring. When the heterocyclic group is a fused ring, the number of rings contained in the fused ring is preferably 3 or less. Examples of a substituent that may be present in the heterocyclic group include a halogen atom, a hydroxy group, an alkyl group having from 1 to 4 carbon atoms, an alkoxy group having from 1 to 4 carbon atoms, a nitro group, a cyano group, an aliphatic acyl group having from 2 to 4 carbon atoms, a benzoyl group, a phenoxy group, an alkoxycarbonyl group containing an alkoxy group having from 1 to 4 carbon atoms, and a phenoxycarbonyl group.

Specific examples of a suitable heterocyclic ring contained in the optionally substituted heterocyclic group include thiophene, furan, pyrrole, imidazole, pyrazole, isothiazole, isoxazole, pyridine, pyrazine, pyrimidine, pyridazine, triazole, tetrazole, indole, 1H-indazole, purine, 4H-quinolizine, isoquinoline, quinoline, phthalazine, naphthyridine, quinoxaline, quinazoline, cinnoline, pteridine, benzofuran, 1,3-benzodioxole, benzoxazole, benzothiazole, benzimidazole, benzimidazolone, phthalimide, piperidine, piperazine, morpholine, and thiomorpholine.

When $R^{13}$ represents a hydrogen atom, optionally substituted alkyl group, optionally substituted alkenyl group, optionally substituted alkoxy group, optionally substituted aralkyl group, optionally substituted aromatic hydrocarbon group, or optionally substituted heterocyclic group, suitable examples of these groups are similar to those given for $R^1$ to $R^{12}$.

When $R^{13}$ represents a halogen atom, examples of the halogen atom include chlorine, bromine, iodine, and fluorine. Preferable among these halogen atoms is chlorine.

Suitable specific examples of the electron transport materials represented by the chemical formulas (1) to (4) include the following ETM-1 to ETM-8.

ETM-1

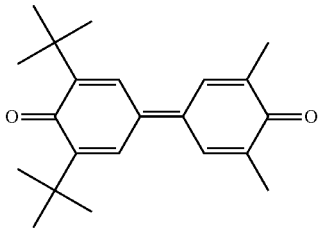

-continued

ETM-2

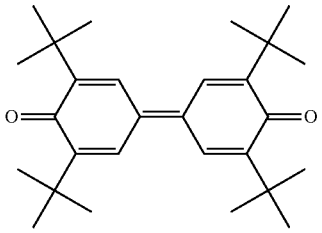

ETM-3

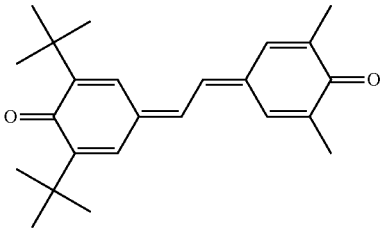

ETM-4

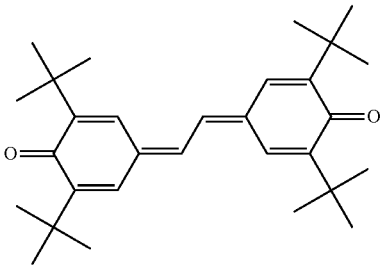

ETM-5

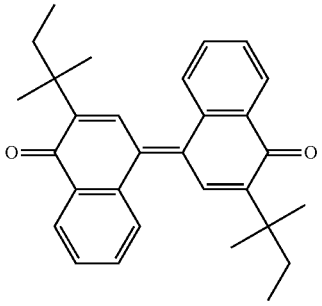

ETM-6

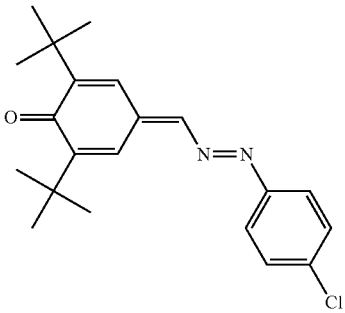

ETM-7

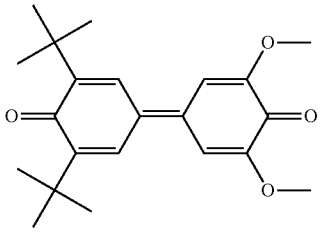

-continued

ETM-8

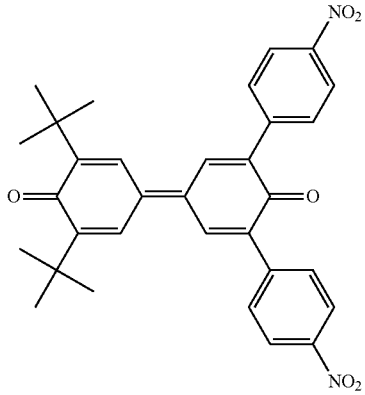

Preferably, the electron transport material is made exclusively from the compounds represented by the chemical formulas (1) to (4). However, the electron transport material may contain one or more other electron transport materials than the compounds represented by the chemical formulas (1) to (4) within a range not to impair the object of the present disclosure. Specific examples of a suitable electron transport material other than the compounds represented by the chemical formulas (1) to (4) include quinone derivatives (for example, naphthoquinone derivatives, diphenoquinone derivatives other than the compounds represented by the chemical formula (1), anthraquinone derivatives, azoquinone derivative other than the compounds represented by the chemical formula (4), nitroanthraquinone derivatives, and dinitroanthraquinone derivatives), malononitrile derivatives, thiopyrane derivatives, trinitrothioxanthone derivatives, 3,4,5,7-tetranitro-9-fluorenone derivatives, dinitroanthracene derivatives, dinitroacridine derivatives, tetracyanoethylene, 2,4,8-trinitrothioxanthone, dinitrobenzene, dinitroanthracene, dinitroacridine, succinic anhydride, maleic anhydride, and dibromomaleic anhydride.

When the electron transport material contains an electron transport material other than the compounds represented by the chemical formulas (1) to (4), the total content of the compounds represented by the chemical formulas (1) to (4) in the electron transport material is preferably at least 80% by mass, more preferably at least 90% by mass, and particularly preferably at least 95% by mass.

The reduction potential of the two or more compounds selected from the group consisting of the compounds represented by the chemical formulas (1) to (4) is not particularly limited within a range not to impair the object of the present disclosure. Typically, the reduction potential of each of the two or more compounds selected from the group consisting of the compounds represented by the chemical formulas (1) to (4) is preferably within a range of −1.05 V to −0.80 V (versus $Ag/Ag^+$). When the reduction potential of each compound falls within such a range, the effect of reducing occurrence of transfer memory by the combined use of the two or more compounds selected from the group consisting of the compounds represented by the chemical formulas (1) to (4) is particularly satisfactory. Consequently, a favorable image can be formed without a defect, such as ghost. The reduction potential may be measured by the following method.

<Method for Measuring Reduction Potential>

The reduction potential is determined by a cyclic voltammetry measurement under the following measurement conditions.

Working electrode: glassy carbon

Counter electrode: platinum

Reference electrode: silver/silver nitrate (0.1 mol/L, $AgNO_3$-acetonitrile solution)

Sample solution electrolyte: tetra-n-butylammonium perchlorate (0.1 mol)

Substance to be measured: electron transport material (0.001 mol)

Solvent: dichloromethane (1 L)

The drift mobility of each of the two or more compounds selected from the group consisting of compounds represented by the chemical formulas (1) to (4) is not particularly limited within a range not to impair the object of the present disclosure. Typically, the drift mobility of each electron transport material, or equivalently, each of the two or more compounds selected from the group consisting of the compounds represented by the chemical formulas (1) to (4) is preferably at least $4.5\times10^{-7}$ $cm^2/V\cdot sec$. When the drift mobility of each compound falls within such a range, the effect of reducing occurrence of transfer memory by the combined use of the two or more compounds selected from the group consisting of the compounds represented by the chemical formulas (1) to (4) is particularly satisfactory. Consequently, a favorable image can be formed without a defect, such as ghost. The drift mobility mentioned above is measured by using a 5 μm-thick film of a polycarbonate resin composition under the conditions where the temperature is 23° C. and the electric field intensity is $3.0\times10^5$ V/cm. The polycarbonate resin composition contains the following in an amount with respect to the total mass of the polycarbonate resin composition: 30% by mass of one or more compound selected from the group consisting of compounds represented by the chemical formulas (1) to (4); and 70% by mass of a bisphenol Z polycarbonate resin having a viscosity-average molecular weight of 50,000. The drift mobility of each compound selected from the group consisting of compounds represented by the chemical formulas (1) to (4) can be measured by the following method.

<Method for Measuring Drift Mobility>

The polycarbonate resin composition mentioned above is added to and dissolved in an organic solvent to prepare an application liquid. The application liquid thus prepared is applied on a substrate made from aluminum and subjected to a heat treatment at 80° C. for 30 minutes to remove the organic solvent to form an applied film having a thickness of 5 μm. Subsequently, a semi-transparent gold electrode is formed on the applied film thus prepared by vacuum vapor deposition to prepare a drift-mobility measurement film. The drift-mobility measurement film is then used to measure the drift mobility by a Time of Flight (TOF) method under the conditions where the temperature is 23° C. and the electric field intensity is $3.0\times10^5$ V/cm.

The viscosity-average molecular weight [M] of the polycarbonate resin is measured by using an Ostwald viscometer to determine the limiting viscosity [η]. Then, according to the Schnell's formula, the limiting viscosity is calculated as follows: $[\eta]=1.23\times10^{-4}[M]^{0.83}$. Note that the limiting viscosity [η] can be measured by using a polycarbonate resin solution. The polycarbonate resin solution is prepared by dissolving a polycarbonate resin in methylene chloride as a solvent to a concentration of 6.0 $g/dm^3$ at a temperature of 20° C.

The molecular weight of the electron transport material is preferably 400 or less. When the electron transport material contains a plurality of compounds, the mass (g) of one mole of the electron transport material is defined as the average molecular weight of the electron transport material.

With the use of the electron transport material having a reduction potential, a drift mobility, and a molecular weight all falling within the respective ranges described above, occurrence of transfer memory during image formation can be more effectively reduced.

(Binder Resin)

The binder resin is not particularly limited and can be any binder resin usable as a binder resin contained in the photosensitive layer of the photosensitive member. Specific examples of a suitably usable binder resin include thermoplastic resins (for example, polycarbonate resins, styrene-based resins, styrene-butadiene copolymers, styrene-acrylonitrile copolymers, styrene-maleic acid copolymers, styrene-acrylic acid copolymers, acrylic copolymers, polyethylene resins, ethylene-vinyl acetate copolymers, chlorinated polyethylene resins, polyvinyl chloride resins, polypropylene resins, ionomers, vinyl chloride-vinyl acetate copolymers, alkyd resins, polyamide resins, polyurethane resins, polyarylate resins, polysulfone resins, diallyl phthalate resins, ketone resins, polyvinyl butyral resins, polyether resins, and polyester resins), thermosetting resins (for example, silicone resins, epoxy resins, phenol resins, urea resins, and melamine resins), and photocurable resins (for example, epoxy acrylate resins, and urethane-acrylate copolymer resins). These resins may be used alone or two or more of the resins may be used in combination.

Of these resins, polycarbonate resins (for example, bisphenol Z polycarbonate resins, bisphenol ZC polycarbonate resins, bisphenol C polycarbonate resins, and bisphenol A polycarbonate resins) are more preferable. The photosensitive layer 14 containing such a polycarbonate resin excels in the balance of workability, mechanical properties, optical properties, and abrasion resistance.

(Additives)

In addition to the charge generating material, the hole transport material, the electron transport material, and the binder resin, the photosensitive layer 14 of the positively chargeable single-layer electrophotographic photosensitive member 10 may contain various additives within a range not adversely affecting the electrophotographic characteristics. Examples of additives which may be added to the photosensitive layer 14 include degradation reducing agents (for example, antioxidants, radical scavengers, singlet quenchers, and ultraviolet absorbers), softeners, plasticizers, surface modifiers, fillers, thickeners, dispersion stabilizers, waxes, acceptors, donors, surfactants, and leveling agents.

(Method for Manufacturing Positively Chargeable Single-Layer Electrophotographic Photosensitive Member)

The method for manufacturing the positively chargeable single-layer electrophotographic photosensitive member 10 is not particularly limited within a range not to impair the object of the present disclosure. A suitable example of the method for manufacturing the positively chargeable single-layer electrophotographic photosensitive member 10 includes one in which an application liquid for the photosensitive layer 14 is applied to the conductive substrate 12 to form the photosensitive layer 14. Specifically, the photosensitive layer 14 may be manufactured by, for example, preparing an application liquid by dissolving or dispersing a charge generating material, a hole transport material, an electron transport material, a binder resin, and various optional additives as required, in a solvent and applying the thus prepared application liquid to the conductive substrate 12, followed by drying. The method for applying the application liquid is not particularly limited, and examples of the application method include a method using a spin coater, an applicator, a spray coater, a bar coater, a dip coater, or a doctor blade. Examples of a method for drying the applied film on the conductive substrate 12 include hot-air drying at a temperature from 80° C. to 150° C. and for 15 minutes to 120 minutes.

The respective contents of the charge generating material, the electron transport material, the hole transport material, and the binder resin in the positively chargeable single-layer electrophotographic photosensitive member 10 are appropriately selected and not particularly limited. Specifically, the content of the charge generating material is preferably within a range of 0.1 to 50 parts by mass with respect to 100 parts by mass of the binder resin, and more preferably within a range of 0.5 to 30 parts by mass. The content of the electron transport material is preferably within a range of 5 to 100 parts by mass with respect to 100 parts by mass of the binder resin, and more preferably within a range of 10 to 80 parts by mass. The content of the hole transport material is preferably within a range of 5 to 500 parts by mass with respect to 100 parts by mass of the binder resin, and more preferably within a range of 25 to 200 parts by mass. In addition, the total content of the hole transport material and the electron transport material, in other words, the content of the charge transport material, is preferably within a range of 20 to 500 parts by mass with respect to 100 parts by mass of the binder resin, and more preferably within a range of 30 to 200 parts by mass.

As to the thickness, the photosensitive layer 14 of the positively chargeable single-layer electrophotographic photosensitive member 10 is without limitation and may have any thickness to be sufficiently operative as the photosensitive layer 14. Specifically, the thickness of the photosensitive layer 14 is preferably within a range of 5 to 100 μm, and more preferably within a range of 10 to 50 μm.

The solvent contained in the application liquid for the photosensitive layer 14 is not particularly limited as long as the respective components of the photosensitive layer 14 can be dissolved or dispersed. Specific examples of such a solvent include alcohols (for example, methanol, ethanol, isopropanol, and buthanol), aliphatic hydrocarbons (for example, n-hexane, octane, and cyclohexane), and aromatic hydrocarbons (for example, benzene, toluene, and xylene), halogenated hydrocarbons (for example, dichloromethane, dichloroethane, carbon tetrachloride, and chlorobenzene), ethers (for example, dimethyl ether, diethyl ether, tetrahydrofuran, ethylene glycol dimethyl ether, and diethylene glycol dimethyl ether), ketones (for example, acetone, methyl ethyl ketone, methyl isobutyl ketone, and cyclohexane), esters (for example, ethyl acetate, and methyl acetate), and aprotic polar organic solvents (for example, dimethyl formaldehyde, dimethyl formamide, and dimethyl sulfoxide). These solvents may be used alone or two or more of the solvents may be used in combination.

As has been described above, the positively chargeable single-layer electrophotographic photosensitive member 10 according to the first embodiment can reduce occurrence of transfer memory and thus reduce occurrence of image defect. Therefore, the positively chargeable single-layer electrophotographic photosensitive member 10 according to the first embodiment is suitably usable as an image bearing member in a variety of image forming apparatuses.

[Second Embodiment]

An image forming apparatus according to the second embodiment includes an image bearing member, a charger, an exposure section, a developing section, and a transfer section. The charger charges a surface of the image bearing member. The exposure section exposes the charged surface of the image bearing member to light to form an electrostatic latent image on the surface of the image bearing member. The developing section develops the electrostatic latent image into a toner image. The transfer section transfers the toner image from the image bearing member to a transfer target. The image bearing member used in the present embodiment is the positively chargeable single-layer electrophotographic photosensitive member 10 according to the first embodiment.

Preferably, in addition, the image forming apparatus according to the second embodiment is a monochrome image forming apparatus or a tandem color image forming apparatus using multiple color toners as described below. The following description is directed to a tandem color image forming apparatus.

The tandem color image forming apparatus according to the present embodiment includes the positively chargeable single-layer electrophotographic photosensitive member 10 and also includes a plurality of image bearing members and a plurality of developing sections. The image bearing members are disposed in parallel to one another in a predetermined direction so as to form toner images formed by toners of different colors on their respective surfaces. Each of the developing sections is disposed to face a corresponding one of the image bearing members and includes a developing roller. Each developing roller holds and carry toner on its surface to supply the tonner to the surface of the corresponding image bearing member. Each image bearing member used in the present embodiment is the positively chargeable single-layer electrophotographic photosensitive member 10 according to the first embodiment.

Figure 2:
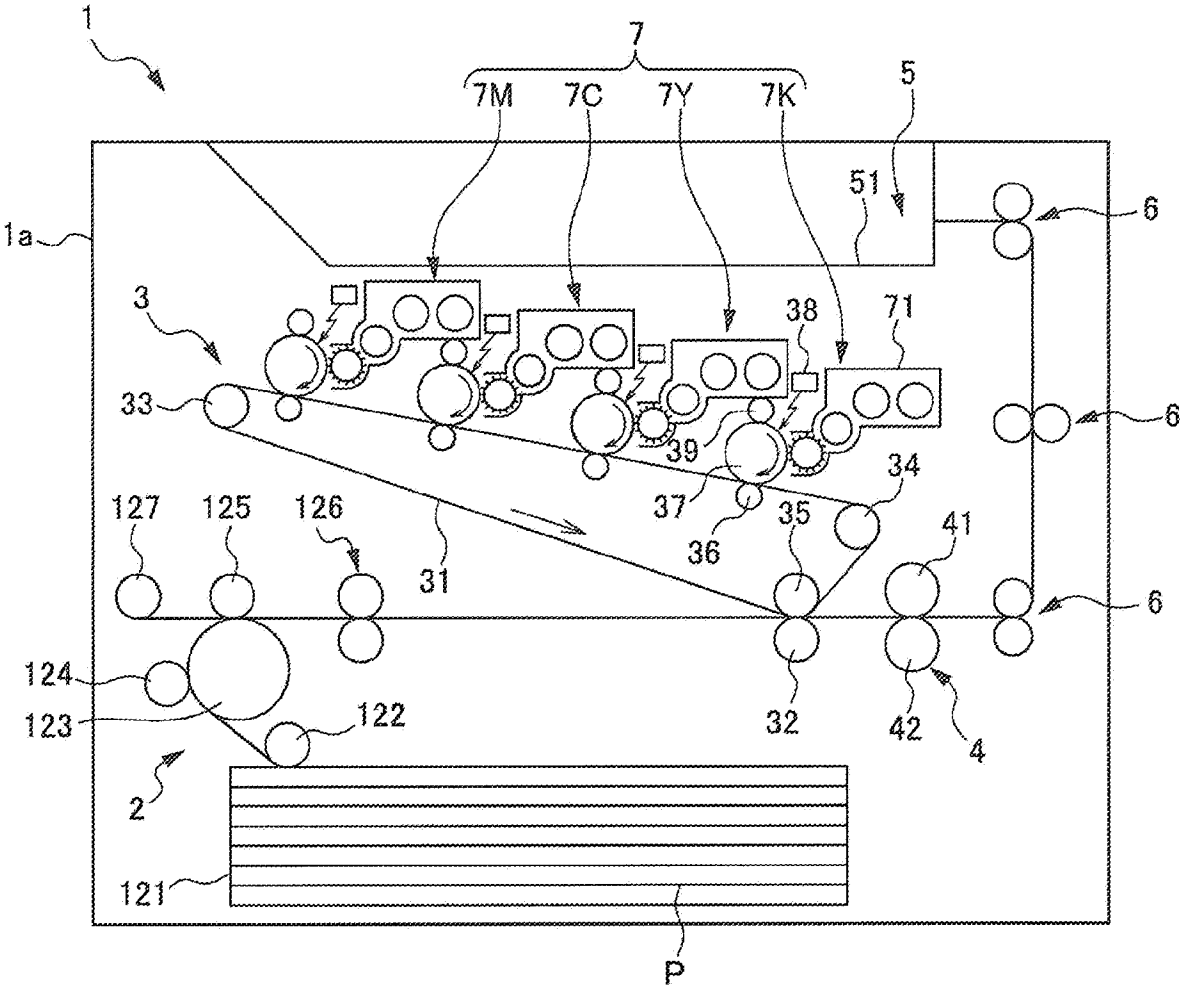
FIG. 2 is a schematic diagram showing one example of an image forming apparatus according to the present disclosure.

FIG. 2 is a schematic view showing a configuration of the image forming apparatus according to the embodiment of the present disclosure, the image forming apparatus including the positively chargeable single-layer electrophotographic photosensitive members 10. The following description is given by way of an example in which the image forming apparatus is a color printer 1.

The color printer 1 includes a boxlike main body 1*a* as shown in FIG. 2. Disposed in the main body 1*a* are a paper feeder 2, an image forming section 3, and a fixing section 4. The paper feeder 2 feeds paper P. While conveying the paper P fed from the paper feeder 2, the image forming section 3 transfers a toner image formed based on image data to the paper P. The fixing unit 4 performs a fixing process so that an unfixed toner image transferred to the paper P by the image forming section 3 is fixed on the paper P. Further, a paper ejecting section 5 is disposed on the upper surface of the main body 1*a*. The paper P having gone through the fixing process by the fixing section 4 is ejected from the paper ejecting section 5.

The paper feeder 2 includes a paper feed cassette 121, a pickup roller 122, paper feed rollers 123, 124 and 125, and registration rollers 126. The paper feed cassette 121 is disposed to be removable from the main body 1*a*. The paper feed cassette 121 stores paper P of different sizes. In FIG. 2, the pickup roller 122 is disposed at an upper left position of the paper feed cassette 121. The pickup roller 122 picks up the paper P stored in the paper feed cassette 121 sheet by sheet. The paper feed rollers 123, 124, and 125 forward the paper P picked up by the pickup roller 122 to a paper conveyance path. The registration rollers 126 temporarily place on standby the paper P forwarded to the paper conveying path by paper feed rollers 123, 124, and 125. Subsequently, the registration rollers 126 feed the paper P to the image forming section 3 with predetermined timing.

The paper feeder 2 further includes a non-illustrated manual feed tray, which is to be attached at the left side of the main body 1*a* in FIG. 2, and a pickup roller 127. The pickup roller 127 picks up the paper P placed in the manual feed tray. The paper P picked up by the pickup roller 127 is forwarded to the paper conveyance path by the paper feed rollers 123 and 125 and then fed to the image forming section 3 by the registration rollers 126 with predetermined timing.

The image forming section 3 includes an image forming unit 7, an intermediate transfer belt 31, and a secondary transfer roller 32. The image forming unit 7 carries out primary transfer so that a toner image, which is formed based on the image data transmitted from a computer or the like, is transferred to the surface of the intermediate transfer belt 31 (to the contact surface with the secondary transfer roller 32). Secondary transfer is carried out by using the secondary transfer roller 32 to transfer the toner image formed on the intermediate transfer belt 31 to the paper P fed from the paper feed cassette 121.

The image forming unit 7 includes a unit for black ink 7K, a unit for yellow ink 7Y, a unit for cyan ink 7C, and a unit for magenta ink 7M that are disposed in the stated order from the upstream side (right side in FIG. 2) to the downstream side. The respective units 7K, 7Y, 7C, and 7M each include a positively chargeable single-layer electrophotographic photosensitive member 37 (hereinafter, photosensitive member 37) as an image bearing member. Each photosensitive member 37 is disposed at a central location of the corresponding unit 7K, 7Y, 7C, or 7M so as to be rotatable in the arrowed direction (clockwise). In addition, to surround the photosensitive member 37, a charger 39, an exposure section 38, a developing section 71, a non-illustrated cleaner section, and an optional non-illustrated static eliminator as required are disposed in the stated order from the upstream side in the rotation direction. Note that the photosensitive member 37 used herein is the positively chargeable single-layer electrophotographic photosensitive member 10 according to the first embodiment.

Each charger 39 uniformly charges the peripheral surface of the corresponding photosensitive member 37 rotating in the arrowed direction. The charger 39 is not particularly limited as long as the peripheral surface of the photosensitive member 37 can be uniformly charged, and may be of a non-contact type or a contact type. Specific examples of the charger 39 include a corona charging device, a charging roller, and a charging brush. The charger 39 is preferably a contact type charging device, such as a charging roller or a charging brush, and more preferably is a charging roller. The use of a contact type charging device as the charger 39 can reduce emission of active gases, such as ozone or nitrogen oxides, generated by the charger 39. This is effective to prevent degradation of the photosensitive layer of the photosensitive member due to the active gases, and also to provide a design contributing to a better office environment, for example.

In the case where the charger 39 is provided with a contact type charging roller, the charger 39 charges the peripheral surface (surface) of the photosensitive member 37 while the charging roller stays in contact with the photosensitive member 37. One example of such a charging roller is a roller that is driven to rotate by following rotation of the photosensitive member 37 while staying in contact with the photosensitive member 37. Further, examples of a charging roller include a roller at least a surface portion of which is formed of a resin. More specifically, the charging roller may have, for example, a cored bar supported to be axially rotatable, a resin layer coating the cored bar, and a voltage application section for applying voltage to the cored bar. The charger 39 that includes such a charging roller can charge the surface of the photosensitive member 37 that is in contact with the charging roller via the resin layer, by applying voltage to the cored bar from the voltage application section.

The voltage applied by the voltage application section to the charging roller is not particularly limited. Yet, a configuration of exclusively applying direct voltage to the charging roller is preferable to a configuration of applying an alternating voltage or superimposed voltage in which direct voltage and alternating voltage are superimposed to the charging roller. The configuration of exclusively applying direct voltage to the charging roller tends to reduce the abrasion amount of the photosensitive layer, which is advantageous for forming favorable images. The direct voltage applied to the positively chargeable single-layer electrophotographic photosensitive member 10 is preferably within a range of 800 to 1800 V, and more preferably within a range of 1000 to 1600 V, and particularly preferably within a range of 1200 to 1400 V.

The resin which is a component of the resin layer of the charging roller is not particularly limited as long as the resin allows the peripheral surface of the photosensitive member 37 to be duly charged. Specific examples of the resin usable for the resin layer include a silicone resin, a urethane resin, and a silicone modified resin. In addition, the resin layer may contain inorganic filler.

The exposure section 38 is so-called a laser scanning unit. The exposure section 38 directs laser light to the peripheral surface of the photosensitive member 37 having been uniformly charged by the charger 39, based on image data input from a personal computer (PC), which is a higher-level device. As a result, an electrostatic latent image based on the image data is formed on the photosensitive member 37. The developing section 71 supplies toner to the peripheral surface of the photosensitive member 37 having the electrostatic latent image formed thereon, thereby to form a toner image based on the image data. The toner image is then transferred to the intermediate transfer belt 31 in the primary transfer. After completion of the primary transfer of the toner image to the intermediate transfer belt 31, the cleaner section cleans residual toner from the peripheral surface of the photosensitive member 37. The static eliminator eliminates the peripheral surface of the photosensitive member 37 after completion of the primary transfer. As sequentially cleaned by the cleaner section and the static eliminator, the peripheral surface of the photosensitive member 37 is forwarded toward the charger 39 where the peripheral surface is newly subjected to charging. Note that neither the cleaner section nor the static eliminator is shown in the figures.

The intermediate transfer belt 31 is a rotating endless belt. The intermediate transfer belt 31 is wound around a plurality of rollers (a drive roller 33, a driven roller 34, a backup roller 35, and a plurality of primary transfer rollers 36) and in contact with the peripheral surface of each photosensitive member 37 at its surface (contact surface with each photosensitive member 37). In addition, the intermediate transfer belt 31 is pressed against each photosensitive member 37 by the corresponding primary transfer roller 36 disposed opposite to the photosensitive member 37. Being pressed by the photosensitive members 37, the intermediate transfer belt 31 rotates by following rotation of the plurality of rollers. The drive roller 33 is driven to rotate by a drive source (a stepping motor, for example) to cause the intermediate transfer belt 31 to rotate endlessly. The driven roller 34, the backup roller 35, and the primary transfer rollers 36 are disposed to be freely rotatable and driven to rotate by following endless rotation of the intermediate transfer belt 31 driven by the drive roller 33. In addition to making passive rotation by following active rotation of the drive roller 33 via the intermediate transfer belt 31, the rollers 34, 35, and 36 support the intermediate transfer belt 31.

The intermediate transfer belt 31 is driven by the drive roller 33 to rotate in the direction indicated by the arrow (counterclockwise) between the respective photosensitive member 37 and the primary transfer rollers 36. The primary transfer roller 36 applies a primary transfer bias (of the reversed polarity to the charging polarity of toner) to the intermediate transfer belt 31. As a result, the toner images formed on the respective photosensitive members 37 are sequentially transferred (primarily transferred) to be overlaid on the intermediate transfer belt 31. Thereafter, as needed, charge is eliminated by the static eliminator (not illustrated), which is optionally provided for eliminating charges on the surface of each photosensitive member 37 with neutralizing light. Thereafter, the respective photosensitive members 37 are further rotated to move onto the subsequent process.

The secondary transfer roller 32 applies a secondary transfer bias, which is of the reversed polarity to the charging polarity of toner image, to the paper P. As a result, the toner images transferred in the primary transfer to the intermediate transfer belt 31 are transferred to the paper P passing between the secondary transfer roller 32 and the backup roller 35. Through the above operation, a color image, which is an unfixed toner image, is transferred to the paper P.

Note that the second embodiment is directed to an image forming apparatus of an intermediate-transfer-type employing the intermediate transfer belt 31. However, the positively chargeable single-layer electrophotographic photosensitive member 10 according to the first embodiment is likewise suitable to an image forming apparatus of a direct-transfer-type. In the direct-transfer-type image forming apparatus, toner images developed on the respective surfaces of the photosensitive members 37 are directly transferred to the paper P being conveyed by a transfer belt (not shown). In the direct-transfer-type image forming apparatus, adherents resulting from paper P on the surface of each photosensitive member 37 may impose an adverse influence to cause charge reduction. Being affected by the charge reduction, the influence of the transfer memory is more significant in image forming apparatuses of a direct-transfer type. However, the image forming apparatus of the direct-transfer type provided with the positively chargeable single-layer electrophotographic photosensitive member 10 according to the first embodiment can reduce the influence of the transfer memory.

The fixing unit 4 performs a fixing process of fixing an unfixed image transferred to the paper P by the image forming section 3. The fixing unit 4 includes a heating roller 41 that is heated by a conductive heating element, and a pressure roller 42. The heating roller 42 is disposed to face the heating roller 41 and pressed against the heating roller 41 to make contact at its peripheral surface with the peripheral surface of the heating roller 41.

The image transferred to the paper P from the secondary transfer roller 32 by the image forming section 3 is subjected to a fixing process in which the unfixed, transferred image is fixed onto the paper P by heat applied when the paper P passes between the heating roller 41 and the pressure roller 42. The paper P having gone through the fixing process is ejected to the paper ejecting section 5. The color printer 1 according to the present embodiment further includes one or more conveyance rollers 6 each at an appropriate location between the fixing section 4 and the paper ejecting section 5.

The paper ejecting section 5 is a recess formed on the top of the main body 1*a* of the color printer 1. The paper ejecting section 5 is provided with an exit tray 51 for receiving paper P ejected to the bottom of the recess.

Through the image forming operation described above, the color printer 1 forms an image on the paper P. The tandem color image forming apparatus as described above includes, as the image bearing member, the positively chargeable single-layer electrophotographic photosensitive member 10 according to the first embodiment. Therefore, such an image forming apparatus can reduce occurrence of transfer memory and thus can form favorable images.

EXAMPLES

The following more specifically describes the present disclosure by way of examples. It should be noted that the present disclosure is in no way limited by the examples.

In Examples and Comparative Examples, the following electron transport materials (ETM-1 through ETM-11) were used.

<Electron Transport Material>

ETM-1

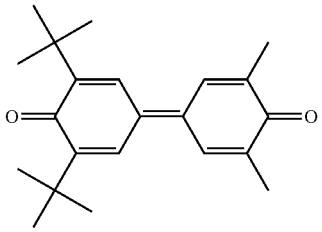

ETM-2

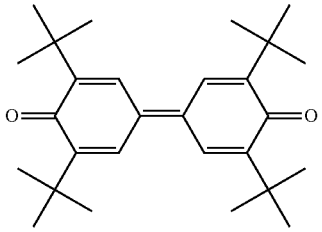

ETM-3

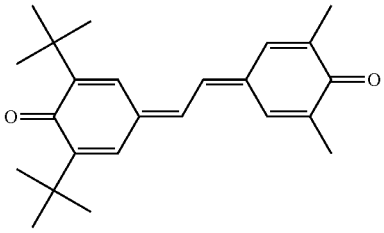

ETM-4

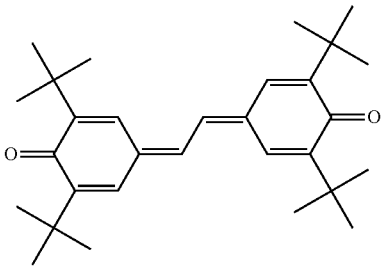

-continued

ETM-5

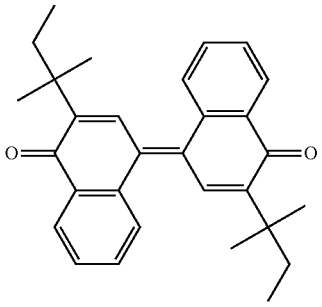

ETM-6

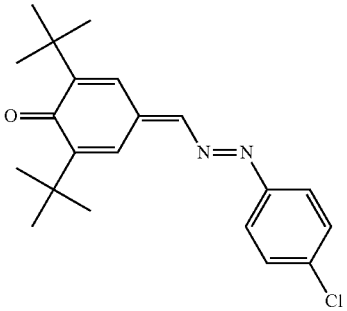

ETM-7

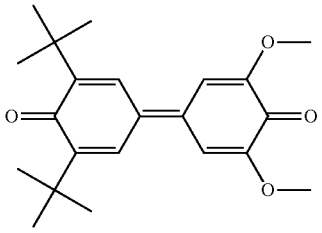

ETM-8

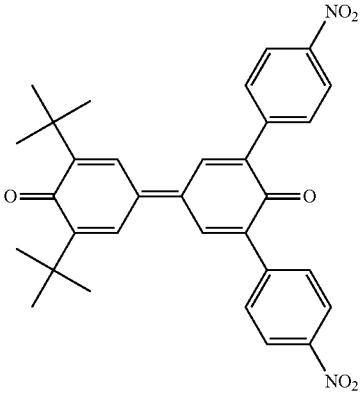

ETM-9

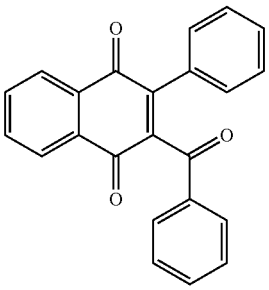

-continued

ETM-10

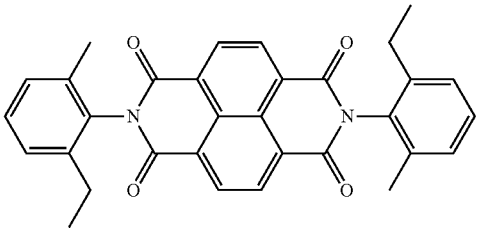

ETM-11

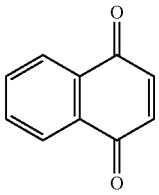

The reduction potential and the drift mobility of each of ETM-1 to ETM-11 were measured by the following method. Table 1 shows the drift mobility and the reduction potential of each of ETM-1 to ETM-11 contained in the respective samples.

<Method for Measuring Drift Mobility>

With respect to the total mass of each sample, a bisphenol Z polycarbonate resin having a viscosity average molecular weight of 50,000 was added to an organic solvent in an amount of 70% by mass, in addition to 30% by mass of the electron transport material (which is a corresponding one of ETM-1 to ETM-11). In addition, a polycarbonate resin and the sample were dissolved in the organic solvent to prepare an application liquid. The application liquid thus obtained was applied to a substrate made from aluminum and then subjected to a heat treatment at 80° C. for 30 minutes to remove the organic solvent to form an applied film having a thickness of 5 μm. Next, a semi-transparent gold electrode was formed on the applied film by vacuum vapor deposition to prepare a drift mobility measurement film. Each drift mobility measurement film thus obtained was used to measure the drift mobility by a time-of-flight (TOF) technique under the conditions that the temperature was 23° C. and the electric field intensity was $3.0\times10^5$ V/cm.

<Method for Measuring Reduction Potential>

The reduction potential was determined by cyclic voltammetry measurement under the following measurement conditions.

Working electrode: glassy carbon

Counter electrode: platinum

Reference electrode: silver/silver nitrate (0.1 mol/L, $AgNO_3$-acetonitrile solution)

Sample solution electrolyte: tetra-n-butylammonium perchlorate (0.1 mol)

Substance to be measured: electron transport material (0.001 mol)

Solvent: dichloromethane (1 L)

TABLE 1

| | Drift Mobility [$cm^2/V \cdot sec$] | Reduction Potential [V] |
|---|---|---|
| ETM-1 | $5.00 \times 10^{-7}$ | −0.93 |
| ETM-2 | $5.12 \times 10^{-7}$ | −0.96 |
| ETM-3 | $6.77 \times 10^{-7}$ | −0.96 |
| ETM-4 | $6.43 \times 10^{-7}$ | −0.95 |
| ETM-5 | $4.70 \times 10^{-7}$ | −0.88 |

TABLE 1-continued

| | Drift Mobility [$cm^2/V \cdot sec$] | Reduction Potential [V] |
|---|---|---|
| ETM-6 | $6.50 \times 10^{-7}$ | −0.93 |
| ETM-7 | $1.10 \times 10^{-8}$ | −1.10 |
| ETM-8 | $1.60 \times 10^{-8}$ | −0.77 |
| ETM-9 | $2.50 \times 10^{-7}$ | −0.90 |
| ETM-10 | $1.20 \times 10^{-7}$ | −0.93 |
| ETM-11 | $3.50 \times 10^{-7}$ | −1.05 |

Examples and Comparative Examples each included X-form metal-free phthalocyaninee (X—$H_2$Pc) represented by the chemical formula (I) as the charge generating material.

In addition, Examples and Comparative Examples each included Resin-1 shown below as the binder resin, and HTM-1 shown below as the hole transport material.

<Binder Resin>

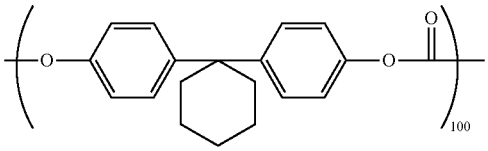

Resin-1

<Hole Transport Material>

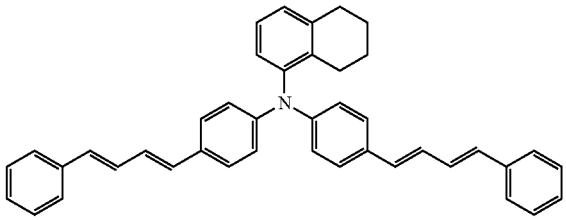

HTM-1

Examples 1-26, Reference Examples 1-5, and Comparative Examples 1-10

Examples 1-26, Reference Examples 1-5, and Comparative Examples 1-10 each included the two types of electron transport materials, ETM-A and ETM-B listed in Tables 2 and 3 as the electron transport material. Each electron transport material was blended in a vessel to have the ratio by mass of ETM-A ($W_A$) to ETM-B ($W_B$) (ratio $W_A/W_B$) shown in Tables 2 and 3.

Then, 35 parts by mass of the electron transport material, 5 parts by mass of the charge generating material, 100 parts by mass of the binder resin (Resin-1), 50 parts by mass of the hole transport material (HTM-1), and 800 parts by mass of tetrahydrofuran were added into a ball mill, followed by mixing and dispersion for 50 hours. As a result, application liquids for the respective photosensitive layers were prepared. Each application liquid thus prepared was applied to a conductive substrate by dip coating, followed by a treatment at 100° C. for 40 minutes to remove tetrahydrofuran from the applied film to prepare a positively chargeable single-layer electrophotographic photosensitive member provided with a 30 μm-thick photosensitive layer.

Comparative Examples 11-19

Positively chargeable single-layer electrophotographic photosensitive members were prepared in the same manner as Example 1 except that the electron transport material included therein was one electron transport material ETM-A listed in Table 3.

<Evaluation of Images>

The positively chargeable single-layer electrophotographic photosensitive members of Examples and Comparative Examples were each mounted in a printer (FS-5250DN manufactured by KYOCERA Document Solutions Inc.) that includes, as the charger, a charging roller for applying direct voltage. The potential difference between a blank paper portion in the absence of a transfer bias and a blank paper portion in the presence of a transfer bias was evaluated as transfer memory. Note that the printer used in the evaluations included a charging rubber roller (epichrolohydrin rubber in which conductive carbon is dispersed) as the charger. In addition, the transfer method employed in the printer used in evaluations was an intermediate transfer method. In the intermediate transfer method, a toner image formed on the drum was transferred to a paper medium via the transfer belt. In addition, an evaluation image was printed after one hour of durability test printing to evaluate occurrence of image defect. The printed image produced after one hour of durability test printing by the evaluation printer provided with the charging roller for applying direct voltage to the charger was visually inspected for any image defect. Occurrence of image defect is evaluated based on the following criteria. Evaluations as being "Very good" and "Good" are determined to be acceptable.

Very good: No image defect was observed.

Good: A void, which is a type of image defect, measuring 10 mm on a side was observed as a ghost in a halftone portion.

Normal: A void, which is a type of image defect, measuring 10 mm on a side was observed as a ghost in a halftone portion, in addition to a void having the shape of an alphabet letter measuring 3 mm on a side was observed as a ghost although not clearly noticeable.

Poor: A void, which is a type of image defect, having the shape of an alphabet letter measuring 3 mm on a side was clearly observed as a ghost.

The evaluation results on the images are shown in Tables 2 and 3, along with the corresponding transfer memory potential (V).

TABLE 2

| Example | ETM-A | ETM-B | $W_A/W_B$ | Transfer memory potential [V] | Image |
|---|---|---|---|---|---|
| 1 | ETM-1 | ETM-2 | 1.0 | −12 | very good |
| 2 | ETM-1 | ETM-3 | 1.0 | −13 | very good |
| 3 | ETM-1 | ETM-4 | 1.0 | −12 | very good |
| 4 | ETM-1 | ETM-5 | 1.0 | −13 | very good |
| 5 | ETM-1 | ETM-6 | 1.0 | −12 | very good |
| 6 | ETM-2 | ETM-3 | 1.0 | −11 | very good |
| 7 | ETM-2 | ETM-4 | 1.0 | −12 | very good |
| 8 | ETM-2 | ETM-5 | 1.0 | −13 | very good |
| 9 | ETM-2 | ETM-6 | 1.0 | −12 | very good |
| 10 | ETM-3 | ETM-4 | 1.0 | −13 | very good |
| 11 | ETM-3 | ETM-5 | 1.0 | −10 | very good |
| 12 | ETM-3 | ETM-6 | 1.0 | −11 | very good |
| 13 | ETM-4 | ETM-5 | 1.0 | −12 | very good |
| 14 | ETM-4 | ETM-6 | 1.0 | −13 | very good |
| 15 | ETM-5 | ETM-6 | 1.0 | −10 | very good |
| 16 | ETM-1 | ETM-5 | 0.1 | −11 | very good |
| 17 | ETM-1 | ETM-5 | 0.2 | −10 | very good |
| 18 | ETM-1 | ETM-5 | 0.5 | −12 | very good |
| 19 | ETM-1 | ETM-5 | 1.0 | −13 | very good |
| 20 | ETM-1 | ETM-5 | 2.0 | −10 | very good |
| 21 | ETM-1 | ETM-5 | 5.0 | −11 | very good |
| 22 | ETM-1 | ETM-5 | 10.0 | −12 | very good |

TABLE 2-continued

| Example | ETM-A | ETM-B | $W_A/W_B$ | Transfer memory potential [V] | Image |
|---|---|---|---|---|---|
| 23 | ETM-2 | ETM-3 | 0.1 | −10 | very good |
| 24 | ETM-2 | ETM-3 | 0.2 | −13 | very good |
| 25 | ETM-2 | ETM-3 | 0.5 | −12 | very good |
| 26 | ETM-2 | ETM-3 | 1.0 | −13 | very good |
| 27 | ETM-2 | ETM-3 | 2.0 | −10 | very good |
| 28 | ETM-2 | ETM-3 | 5.0 | −13 | very good |
| 29 | ETM-2 | ETM-3 | 10.0 | −13 | very good |
| 30 | ETM-1 | ETM-7 | 1.0 | −26 | good |
| 31 | ETM-1 | ETM-8 | 1.0 | −25 | good |

TABLE 3

| Comparative Example | ETM-A | ETM-B | $W_A/W_B$ | Transfer memory potential [V] | Image |
|---|---|---|---|---|---|
| 1 | ETM-1 | ETM-9 | 1.0 | −32 | poor |
| 2 | ETM-1 | ETM-10 | 1.0 | −30 | normal |
| 3 | ETM-1 | ETM-11 | 1.0 | −33 | poor |
| 4 | ETM-2 | ETM-11 | 1.0 | −35 | poor |
| 5 | ETM-3 | ETM-11 | 1.0 | −32 | poor |
| 6 | ETM-4 | ETM-11 | 1.0 | −34 | poor |
| 7 | ETM-5 | ETM-11 | 1.0 | −33 | poor |
| 8 | ETM-6 | ETM-11 | 1.0 | −31 | poor |
| 9 | ETM-9 | ETM-11 | 1.0 | −65 | poor |
| 10 | ETM-10 | ETM-11 | 1.0 | −55 | poor |
| 11 | ETM-1 | — | — | −35 | poor |
| 12 | ETM-2 | — | — | −38 | poor |
| 13 | ETM-3 | — | — | −41 | poor |
| 14 | ETM-4 | — | — | −38 | poor |
| 15 | ETM-5 | — | — | −43 | poor |
| 16 | ETM-6 | — | — | −37 | poor |
| 17 | ETM-9 | — | — | −70 | poor |
| 18 | ETM-10 | — | — | −40 | poor |
| 19 | ETM-11 | — | — | −75 | poor |

Examples 1-26 and Reference Examples 1-5 reveal that occurrence of transfer memory can be reduced with the use of two or more compounds selected from the group consisting of compounds represented by the chemical formulas (1) to (4), as the electron transport material contained in the photosensitive layer of the positively chargeable single-layer electrophotographic photosensitive member. Therefore, favorable images are formed without an image defect, such as a ghost.

Comparative Examples 1-8 reveal that occurrence of transfer memory cannot be reduced with the combined use of one compound selected from the group consisting of compounds represented by the chemical formulas (1) to (4) and a compound not selected from the group consisting of compounds represented by the chemical formulas (1) to (4), as the electron transport material contained in the photosensitive layer of the positively chargeable single-layer electrophotographic photosensitive member contains. Therefore, occurrence of an image defect, such as a ghost, cannot be prevented.

Comparative Examples 9 and 10 reveal that occurrence of transfer memory cannot be reduced with the combined use of two or more compounds not included in the group of compounds represented by the chemical formulas (1) to (4), as the electron transport material contained in the photosensitive layer of the positively chargeable single-layer electrophotographic photosensitive member. Therefore, occurrence of an image defect, such as a ghost, cannot be prevented.

Comparative Examples 11-16 revel that occurrence of transfer memory cannot be reduced with the use of a single compound selected from the group consisting of compounds represented by the chemical formulas (1) to (4), as the electron transport material contained in the photosensitive layer of a positively chargeable single-layer electrophotographic photosensitive member. Therefore, occurrence of an image defect, such as a ghost, cannot be prevented.

Comparative Examples 17-19 reveal that occurrence of transfer memory cannot be reduced with the use of a single compound not included in the group of compounds represented by the chemical formulas (1) to (4), as the electron transport material contained in the photosensitive layer of a positively chargeable single-layer electrophotographic photosensitive member. Therefore, occurrence of an image defect, such as a ghost, cannot be prevented.

What is claimed is:

1. A positively chargeable single-layer electrophotographic photosensitive member comprising:

a conductive substrate; and a single-layer photosensitive layer over the conductive substrate, wherein the single-layer photosensitive layer contains a charge generating material, a hole transport material, an electron transport material, and a binder resin, the electron transport material contains a first compound and a second compound, and the first compound is represented by the chemical formula ETM-3 and the second compound is represented by one of the chemical formula ETM-7, the chemical formula ETM-8, and the chemical formula ETM-5, or the first compound is represented by the chemical formula ETM-5 and the second compound is represented by one of the chemical formula ETM-7 and the chemical formula ETM-8:

ETM-3

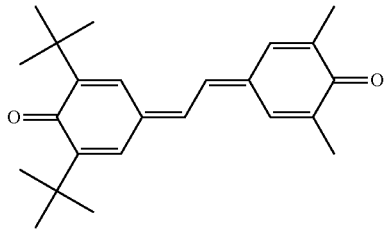

ETM-5

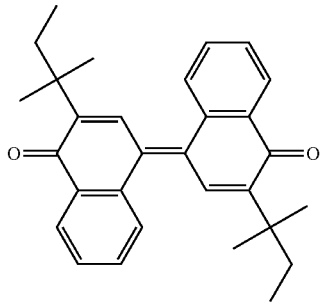

ETM-7

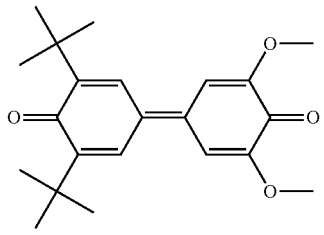

-continued

ETM-8

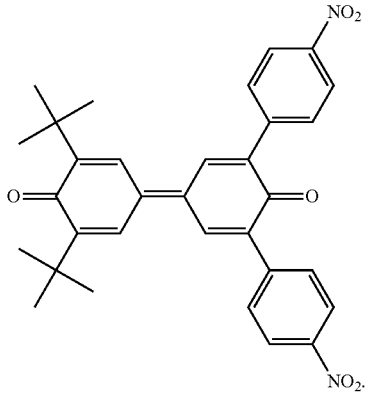

2. A positively chargeable single-layer electrophotographic photosensitive member according to claim 1, wherein each of the first compound and the second compound has a drift mobility of at least $4.5\times10^{-7}$ $cm^2/V\cdot sec$.

3. A positively chargeable single-layer electrophotographic photosensitive member according to claim 1, wherein each of the first compound and the second compound has a reduction potential within a range of −1.05 to −0.80 V versus $Ag/Ag^{+}$.

4. An image forming apparatus comprising:

an image bearing member;

a charger configured to charge a surface of the image bearing member;

an exposure section configured to expose the charged surface of the image bearing member to light to form an electrostatic latent image on the surface of the image bearing member;

a developing section configured to develop the electrostatic latent image into a toner image; and a transfer section configured to transfer the toner image from the image bearing member to a transfer target, wherein the image bearing member is a positively chargeable single-layer electrophotographic photosensitive member according to claim 1.

5. An image forming apparatus according to claim 4, wherein the charger is a contact charger configured to apply direct voltage.

6. A positively chargeable single-layer electrophotographic photosensitive member according to claim 1, wherein the first compound is represented by the chemical formula ETM-3 and the second compound is represented by one of the chemical formula ETM-8, and the chemical formula ETM-5, or the first compound is represented by the chemical formula ETM-5 and the second compound is represented by the chemical formula ETM-8.

7. A positively chargeable single-layer electrophotographic photosensitive member according to claim 1, wherein the first compound is represented by the chemical formula ETM-3, and the second compound is represented by the chemical formula ETM-5.

* * * * *